United States Patent [19]

Pentney

[11] 4,073,407

[45] Feb. 14, 1978

[54] DISPENSING CONTAINER WITH FRANGIBLE WEBS

[75] Inventor: Harry Pentney, Spencers Wood, England

[73] Assignee: The Gillette Company, Boston, Mass.

[21] Appl. No.: 714,509

[22] Filed: Aug. 16, 1976

[30] Foreign Application Priority Data

Aug. 15, 1975 United Kingdom ..... 34148/75

[51] Int. Cl.[2] ..... B65D 83/10

[52] U.S. Cl. ..... 221/102; 206/357

[58] Field of Search ..... 221/279, 280, 102, 250; 206/357, 358, 39.5; 312/42, 50, 71

[56] References Cited

U.S. PATENT DOCUMENTS 3,421,658 1/1969 Cooksey ..... 206/358 X

*Primary Examiner*—Stanley H. Tollberg

*Attorney, Agent, or Firm*—Richard A. Wise; Oistein J. Bratlie; Scott R. Foster

[57] ABSTRACT

A dispensing container for double edged razor blades, the container comprising a storage compartment for a stack of blades and a dispensing opening at one end of the compartment, the opening being defined by portions of a single, integral moulding, which portions are substantially spaced apart in the moulded condition of the moulding, but are relatively movable into a final position in which they are closer together to define the dispensing opening.

9 Claims, 5 Drawing Figures

DISPENSING CONTAINER WITH FRANGIBLE WEBS

This invention relates to dispensing containers for double edged razor blades of the generally known form in which a stack of blades is housed in a container having a dispensing opening through which the blades can be ejected one-by-one, usually by the thumb of the user engaging the uppermost blade through a hole in the top wall of the container and pushing the blade through the opening.

The invention provides a dispensing container for double edged razor blades, comprising a storage compartment for a stack of blades and a dispensing opening at one end of the compartment, wherein the dispensing opening is defined by portions of a single, integral moulding, which portions are substantially spaced apart in the moulded condition of the moulding, but are relatively movable into a final position in which they are closer together to define the dispensing opening.

With this arrangement, it is possible to form a dispensing container as a one-piece moulding, necessary access to the storage compartment for loading it with a stack of blades being provided by the initial spacing of the relatively movable portions, which are thereafter moved into their final position in which they define the dispensing opening.

In the case in which bare (unwrapped) blades are to be stored and dispensed singly, the above described manner of forming the dispensing opening is of particular advantage compared, for example, with forming the opening as a thin slit in the moulding.

In that case also, means should be provided for lateral location of the blades to protect their cutting edges during their storage and dispensing movement, such as a vertical, resiliently displaceable rib which locates in the central longitudinal slots of standard double-edged razor blades.

One form of dispensing container in accordance with the invention will now be described by way of example, with reference to the accompanying drawings, in which.

Figure 1:
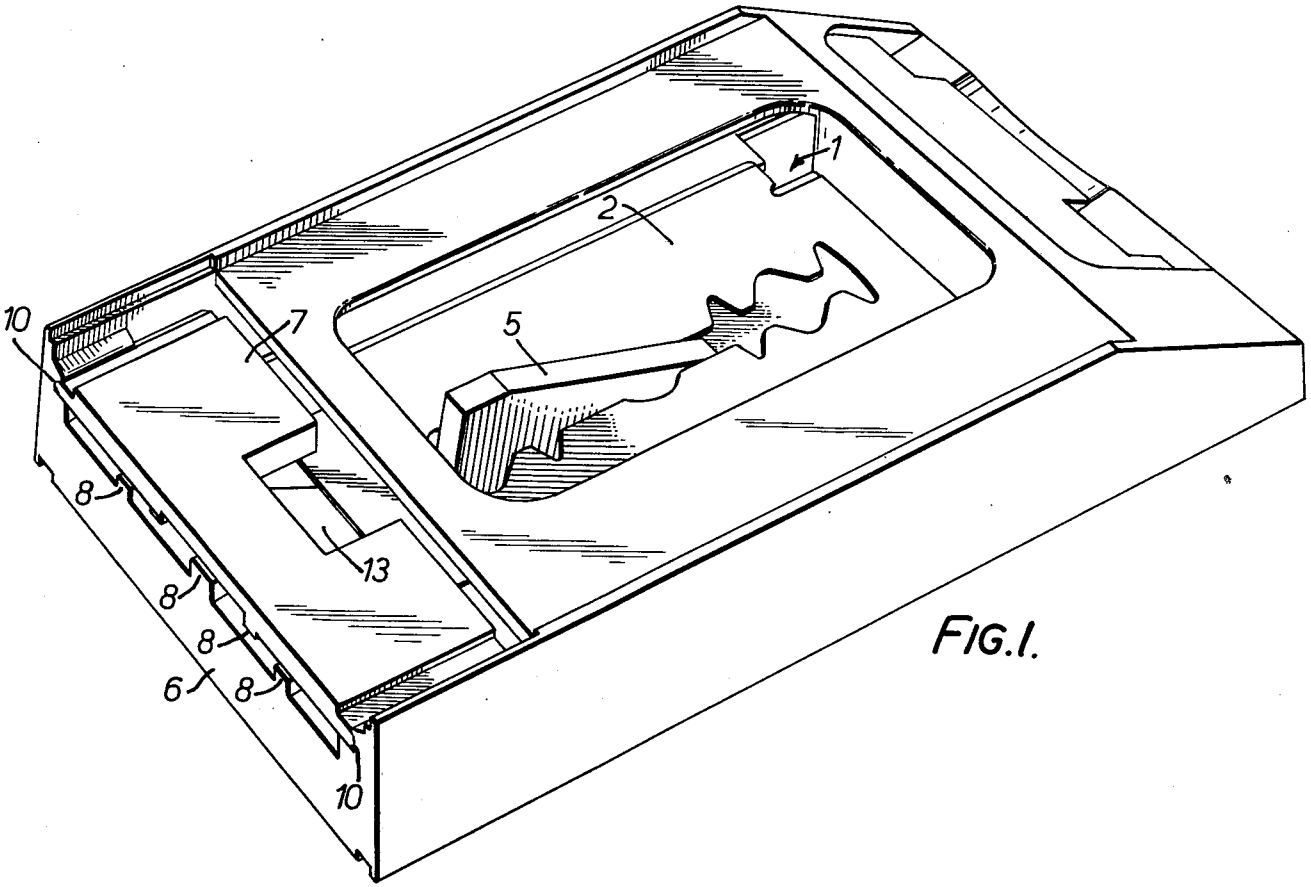
FIG. 1 is a top perspective view of the container.
Figure 2:
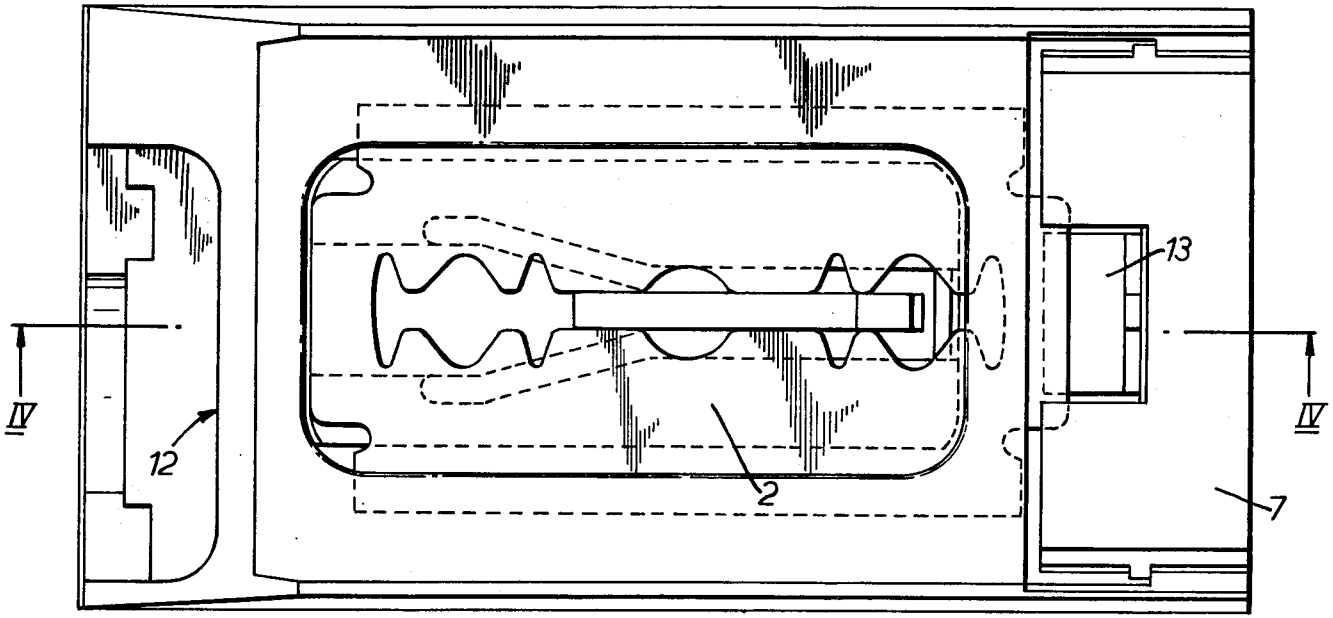
FIG. 2 is a top plan view of the container of FIG. 1.
Figure 3:
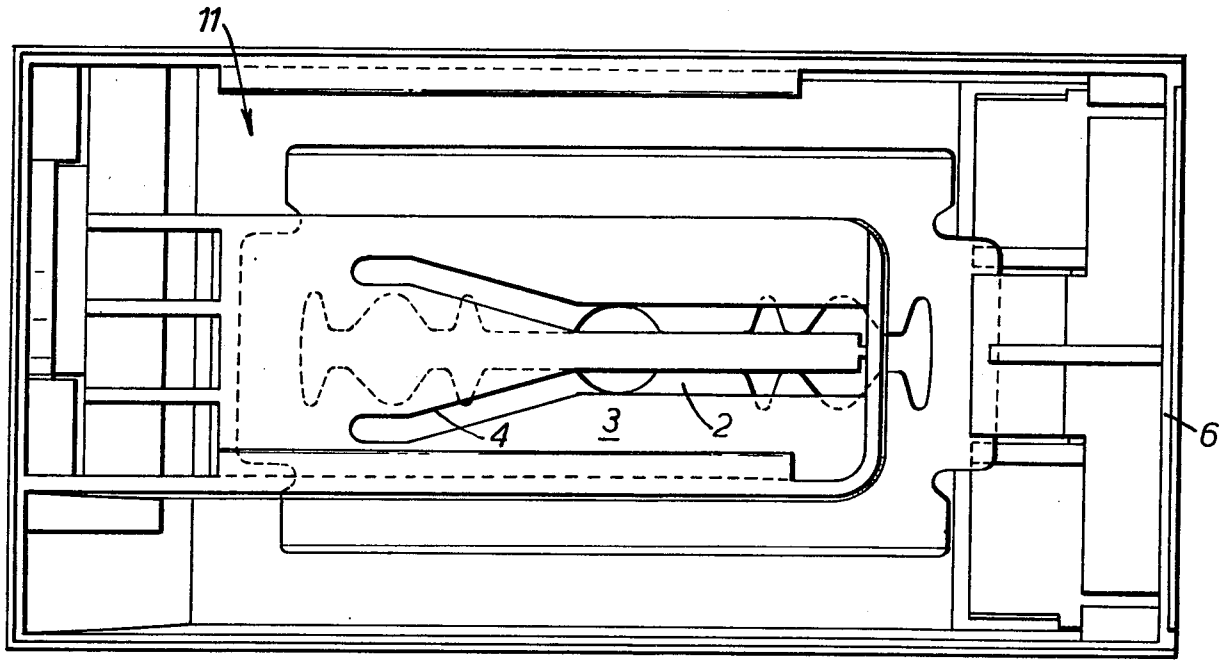
FIG. 3 is a bottom plan view.

The dispensing container shown in the drawings is formed as a one piece moulding of synthetic plastics material having a storage compartment 1 for receiving and storing a stack 2 of double edged razor blades of conventional form having a longitudinal central slot. The floor 3 of the storage compartment is slotted to define triangular portion or fillet 4 integral with a locating rib 5 which extends through longitudinal slots in the blades to locate them laterally and also to restrain them against free movement forwardly of the dispenser, i.e. in the "feed" direction. The fillet 4 is resiliently flexible to permit downward deflection of the locating rib 5.

A dispensing opening at the forward end of the container is defined by a shaped front wall 6 of the container and a bar 7, having respective confronting projections 8 whose spacing corresponds with the thickness of a single blade.

Figure 4:
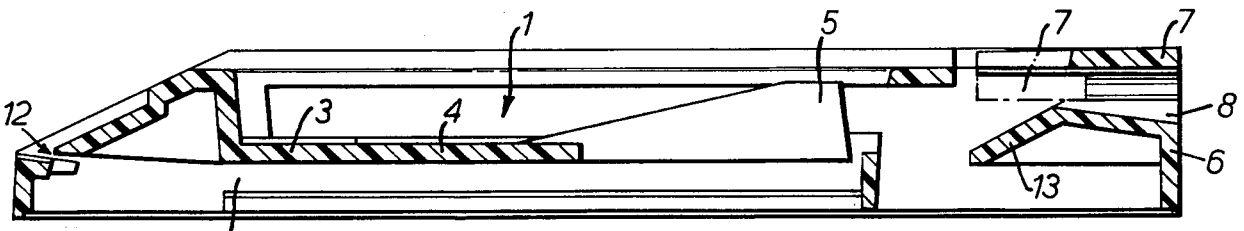
FIG. 4 is a section on the line IV—IV in FIG. 2.
Figure 5:
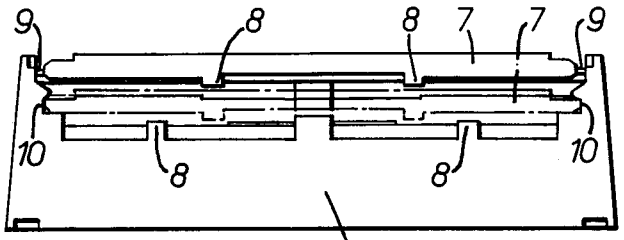
FIG. 5 is a front end view of the container.

The bar 7 is connected to the rest of the moulding by thin membranes or webs 9 (FIG. 5). The container is moulded with the bar 7 in the position shown in full lines in FIGS. 4 and 5, in which it is relatively widely spaced from the front wall 6, to facilitate insertion of the stack of blades into the storage compartment, while the locating rib 5 is held depressed. When the stack is in position, the rib is released to spring back to its illustrated position. The bar is then displaced bodily to stretch or rupture the webs 9 and the ends of the bar snap into recesses 10, the bar now occupying its final position illustrated in chain dot lines in FIGS. 4 and 5.

In use, blades are dispensed singly by pressing down on the top blade and the rib 5, usually with the thumb and pushing the blade forwardly up a guiding ramp 13 and through the dispensing opening.

A storage compartment 11 for used blades is formed in the underside of the container entry to this compartment being given by an opening 12 at the rear end of the container.

If desired, the storage compartment may be concealed by a thin film of plastics material (not shown) welded to the underside of the container.

What we claim is:

1. A dispensing container for double edged razor blades, comprising a storage compartment for a stack of blades and a dispensing opening at one end of the compartment, wherein the dispensing opening is defined by first and second portions of a single, integral moulding, which portions are substantially spaced apart in the moulded condition of the moulding, but are relatively movable into a final position in which they are closer together to define the dispensing opening, said first portion being fast with said compartment and said second portion being connected initially to the remainder of the moulding by thin webs which are readily frangible to permit displacement of the second portion into its final position.

2. A dispensing container according to claim 1, wherein the second portion comprises an elongate bar.

3. A dispensing container according to claim 2, wherein the bar is attached to the remainder of the moulding only at its ends.

4. A dispensing container according to claim 3, wherein the moulding has upstanding side walls at the ends of the dispensing opening and recesses in the side walls, and the ends of the bar make snap-fitting engagement in the recesses in the final position of the bar.

5. A dispensing container according to claim 4, wherein the confronting surfaces of the bar and the said one portion are formed with projections which define the width of the dispensing opening.

6. A dispensing container according to claim 1, wherein the compartment is provided with a locating rib which projects upwardly from the floor of the compartment but is resiliently displaceable by downward manual pressure, the rib serving in use to locate a stack of blades of the standard form having a central longitudinal slot.

7. A dispensing container according to claim 1, including a storage compartment for used blades.

8. A dispensing container according to claim 1 and formed as a one piece moulding of synthetic plastics material.

9. A dispensing container for double edged razor blades comprising an integral moulding of synthetic plastics material defining a storage compartment having a central floor portion carrying an upstanding locating rib and a top wall having an aperture therein large enough to permit insertion of the thumb or finger of a user to depress the rib and floor portion resiliently, the rear end of the storage compartment being closed and the front end being defined by a fixed lower wall and a bar spaced from the lower wall and extending laterally of the container and connected thereto by readily frangible webs or membranes which initially locate the bar at a distance from the lower wall sufficient to permit the insertion therebetween into the storage compartment of a stack of standard double-edged razor blades, and wherein the bar is displaceable into a second position, closer to the bottom wall, in which it defines with the bottom wall a dispensing opening wide enough only to permit the passage of individual blades therethrough.

* * * * *